United States Patent [19]

Banike

[11] Patent Number: 4,577,560

[45] Date of Patent: Mar. 25, 1986

[54] GAPLESS LOCK-UP FOR OFFSET PRINTING CYLINDERS

[75] Inventor: Ronald Banike, Orland Park, Ill.

[73] Assignee: R. R. Donnelley & Sons Company, Chicago, Ill.

[21] Appl. No.: 642,080

[22] Filed: Aug. 20, 1984

[51] Int. Cl.[4] ..... B41F 27/12

[52] U.S. Cl. ..... 101/415.1; 74/99 A

[58] Field of Search ..... 101/415.1, 378; 269/244; 74/216.3, 99 A, 99 R, 55–59, 424.8

[56] References Cited

U.S. PATENT DOCUMENTS

| | | | |
|---|---|---|---|
| 948,157 | 2/1910 | Bevan | 101/415.1 |
| 2,621,592 | 12/1952 | Faeber | 101/415.1 |
| 2,641,183 | 6/1953 | Boyajean, Jr. | 101/415.1 |
| 2,746,344 | 5/1956 | Brodie | 101/415.1 |
| 2,800,819 | 7/1957 | Smith | 269/244 |
| 2,898,854 | 8/1959 | Crawford | 101/415.1 |
| 3,020,842 | 2/1962 | Neal | 101/415.1 |
| 3,027,772 | 4/1962 | Smith | 74/99 |
| 3,036,354 | 5/1962 | De Bie | 101/415.1 X |
| 3,058,417 | 10/1962 | Norlin | 101/415.1 |
| 3,195,468 | 7/1965 | Nystrand | 101/415.1 |
| 3,359,899 | 12/1967 | Luehrs | 101/415.1 |
| 3,362,327 | 1/1968 | Luehrs | 101/415.1 |
| 3,577,822 | 5/1971 | Sauer et al. | 101/415.1 |
| 3,625,151 | 12/1971 | Hart | 101/415.1 |
| 3,750,571 | 8/1973 | Germann | 101/415.1 |
| 3,795,193 | 3/1974 | Johne et al. | 101/415.1 |
| 3,970,001 | 7/1976 | Mollan et al. | 101/415.1 |
| 4,122,774 | 10/1978 | Sauer | 101/415.1 |
| 4,133,264 | 1/1979 | Fermi et al. | 101/415.1 |
| 4,193,178 | 3/1980 | McArthur et al. | 101/415.1 |
| 4,261,262 | 4/1981 | Jeschke | 101/415.1 |

*Primary Examiner*—William Pieprz

*Attorney, Agent, or Firm*—Wood, Dalton, Phillips Mason & Rowe

[57] ABSTRACT

A cylinder of a rotary offset printing machine is provided with a gapless lock-up means for an offset plate or metal backed offset blanket by setting into the cylinder a fixed jaw and a movable jaw that have facing undercut surfaces defining a recess within which the end tabs of an offset plate or metal backed blanket are received. As the jaws are closed the end tabs are clamped firmly between the jaws. A slight tendency of the end tabs to bulge at the outer margins of the jaws is overcome by an anti-creep means which is distorted between the end tabs as the jaws close so as to produce an inward force component on the end tabs.

25 Claims, 4 Drawing Figures

GAPLESS LOCK-UP FOR OFFSET PRINTING CYLINDERS

BACKGROUND OF THE INVENTION

There are two very important reasons for minimizing the width of any gap between the ends of a plate or blanket mounted upon a cylinder of a rotary offset printing machine. The first reason is that when a gap passes through the nip between two cylinders it jars both cylinders; and the magnitude of the jar increases with the width of the gap and the speed at which the machine is running. A press operating at a rate of 1500 fpm (457 meters per minute) requires very heavy bearer construction to withstand the shock produced by a gap in a cylinder surface passing through the nip. The second reason is that when a few miles of paper web are being printed, the paper waste caused by even a small gap can add up to a very substantial amount in any long press run.

A major factor that complicates the problem of reducing the gap where an offset plate or blanket is fastened onto the cylinder is that the extremely high rotational speed of the cylinder necessitates a very strong attachment.

Because of the great importance of minimizing the gap in an offset press cylinder, a variety of different approaches to the problem have been tried by many workers in the art over a long period of years. U.S. Pat. Nos. 2,745,344; 3,058,417; 3,195,458; and 3,362,327 show various attempts to minimize the gap in an offset press cylinder. U.S. Pat. No. 948,157 shows an attempt to minimize the gap between the ends of an abrasive wrapper on a surfacing roll.

SUMMARY OF THE INVENTION

In accordance with the present invention, which is applicable both to plates and to metal backed blankets of an offset press, a fixed jaw and a movable jaw are mounted in a slot that extends lengthwise of an offset cylinder so as to define a recess. The jaws have arcuate outer surfaces flush with the surface of the cylinder and have facing undercut surfaces the outer margins of which intersect the arcuate outer surfaces along small radii of curvature. Thus an offset plate or metal backed blanket having metal end tabs may wrap smoothly around the cylinder and the jaws and have the end tabs lying in uninterrupted facing contact with the outer margins and the undercut surfaces. Intermeshing flanges at the inner margins of the undercut surfaces have top faces that cooperate to define the bottom of the recess. Means is provided for imparting translatory motion to the movable jaw between an open position and a closed position in which the end tabs of an offset plate are clamped between the jaws.

The movement of the movable jaw produces an outward component of force on the end tabs which gives them a tendency to bulge at the outer margins of the undercut surfaces. One embodiment of the invention, therefore, has an anti-creep means lying on the intermeshing flanges extending lengthwise of the recess, and the anti-creep means is distorted between the end tabs as the movable jaw is moved toward closed position. This distortion of the anti-creep means produces an inward force component.

The anti-creep means is annular in cross section and distorts to an oval shape; and in the illustrated embodiment of the invention the anti-creep means is a spring which has canted coils.

A preferred means for imparting translatory motion to the movable jaw comprises a rotatable screw with an arcuate groove, several inclined recesses in the movable jaw which confront the groove, and a ball in each recess engaged with the groove. Spring means biases the screw endwise, and the screw has an end at one end of the cylinder provided with means by which it may be manually rotated.

Compression spring means bias the movable jaw toward open position.

THE DRAWINGS

DETAILED DESCRIPTION OF THE INVENTION

Figure 1:
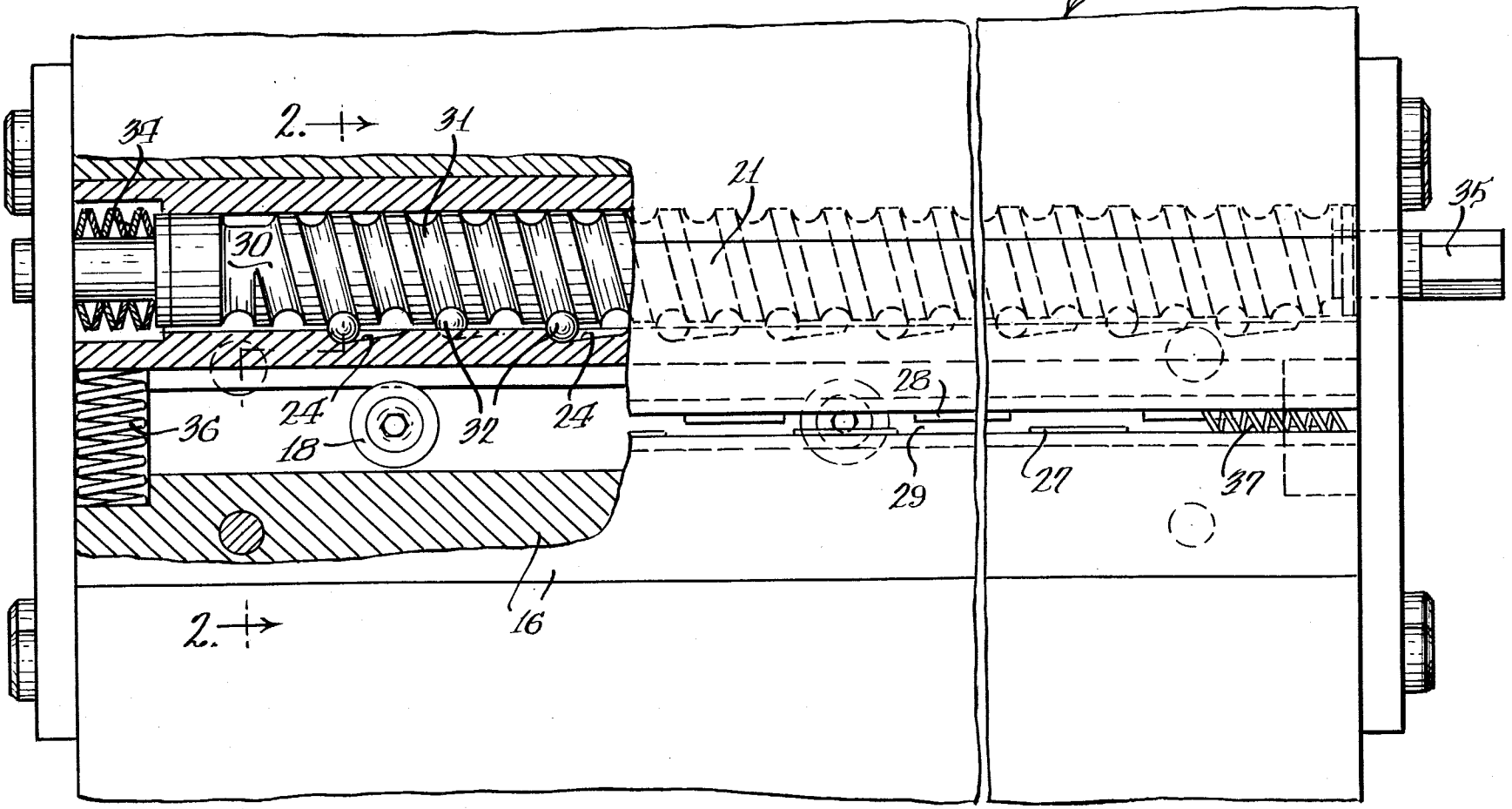
FIG. 1 is a fragmentary, longitudinal elevational view of a plate cylinder embodying the invention, with a part in section to illustrate the rotatable screw and ball bearing means for imparting translatory motion to the movable jaw.

Referring to the drawings in detail, a plate cylinder, indicated generally at 10, has a lengthwise slot 11 at one side of which is an arcuate groove 12. Seated in the bottom of the slot is a base block 13 secured by bolts 13*a*, and recesses 14 in the underside of the base block receive machine screws 15 by means of which a fixed jaw 16 is fixedly secured to the base block. Stepped diameter clips 17 have overhanging heads 18, and flat head screws 19 secure the clips to the base block. The base block 13 is seen to have an outwardly facing arcuate surface 20 which is concentric to a circumferential cylinder surface 10*a*.

Seated upon the arcuate surface 20 of the base block 13 is a movable jaw 21 which has a retaining groove 22 along an inner side to receive the overhanging heads 18 of the clips 17, so that when the jaws are closed the movable jaw is held against centrifugal force. In an outer surface of the movable jaw 21, facing the arcuate groove 12 is an arcuate groove 23 in the surface of which are cut several inclined recesses 24.

The fixed jaw 16 has an arcuate outer surface 16*a* which is flush with the cylinder surface 10*a*, and similarly the movable jaw 21 has an arcuate outer surface 21*a* which is flush with the cylinder surface 10*a*. Facing undercut surfaces 25 on the fixed jaw 16 and 26 on the movable jaw 21 are at an angle of about 40° to one another and intersect the respective arcuate outer surfaces 16*a* and 21*a* along respective outer margins 25*a* and 26*a* along small radii of curvature. Along the inner margins of the undercut surfaces 25 and 26 are respective intermeshing flanges 27 and 28 the tops of which cooperate to define the bottom of a recess 29 the sides of which are defined by the undercut surfaces 25 and 26 of the respective fixed and movable jaws 16 and 21. The angle between the tops of the flanges 27 and 28 is about 140°.

Comparison of the depth of the slot 11 with the arc of the cylinder surface 10*a* shows that the slot occupies only a small fraction of the diameter of the cylinder.

The entire circumferential space occupied by the jaws and the adjusting mechanism is a small fraction of the circumference of the cylinder. Thus the adjusting mechanism does not materially affect the strength of the cylinder.

Means for imparting translatory motion to the movable jaw 21 across the arcuate outwardly facing surface 20 consists of a rotatable screw 30 which is mounted in a cavity defined by the arcuate grooves 12 and 23, said screw having an arcuate helical groove 31; and in each of the several inclined recesses 24 is a ball bearing 32 which is engaged with the groove 31. The rotatable screw 30 bears only against an elongated arcuate thrust block 33 which is mounted in a slot in the arcuate groove 12, and a set of bellville springs 34 urges the screw 30 endwise. The screw has an end at one end of the cylinder which is provided with a hex boss 35 with which a wrench may be engaged for manually rotating the screw. As the screw is rotated the arcuate groove 31 moves the ball bearings 32 from the large ends of the inclined recesses 24 toward the shallower ends of said recesses so as to slide the movable jaw 21 from the open position of FIG. 2 toward the closed position of FIG. 4. A line of compression springs 36, of which only one is illustrated in FIG. 1 of the drawings, biases the movable jaw 21 toward the open position.

As seen in FIG. 1, the screw 30, the fixed jaw 16 and the movable jaw 21 extend from end to end of the cylinder; and the recesses 24 and ball bearings 32 are spaced evenly along the entire length of the movable jaw 21. Thus rotation of the screw 30 applies force to the movable jaw effectively uniformly throughout its length, and there is no differential torque from end to end of the screw 30 as is the case with other types of adjusting mechanisms for elongate members such as the movable jaw 21.

Figure 4:
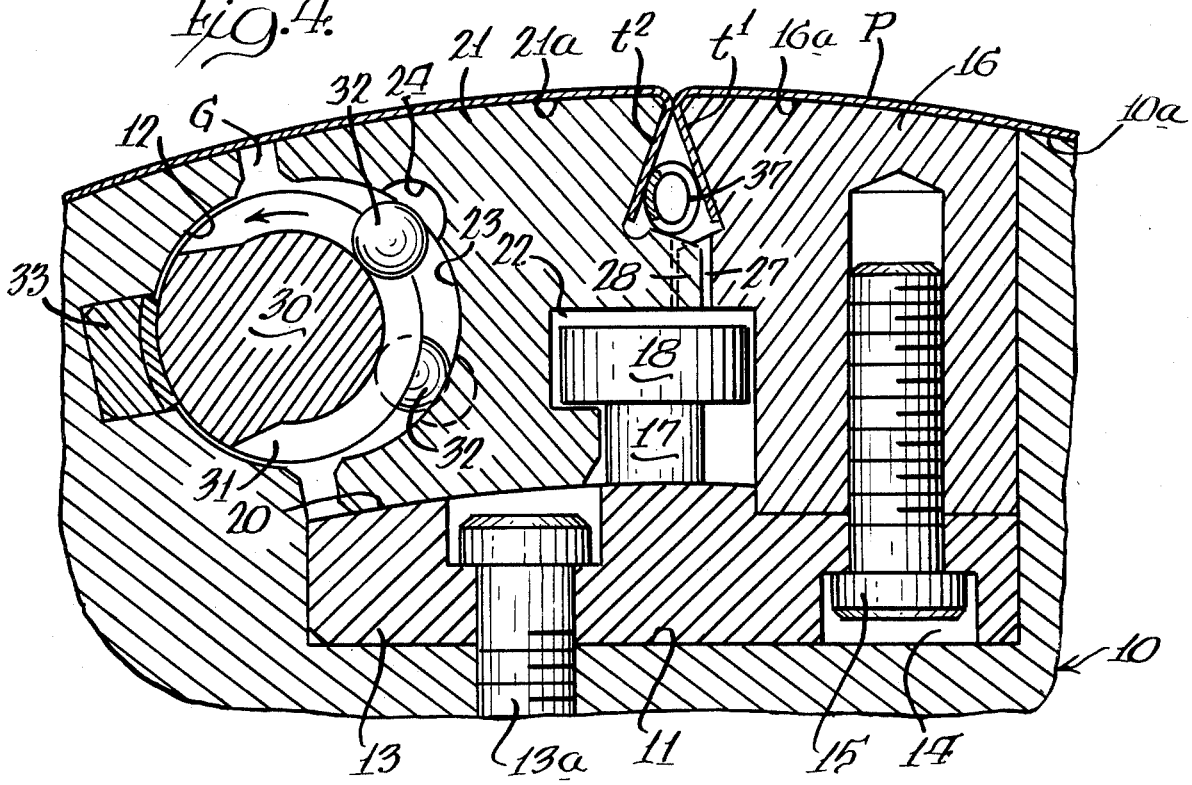
FIG. 4 is a view similar to FIG. 2 with a plate locked onto the cylinder by the action of the lock-up means.

Anti-creep means 37 extends lengthwise of the recess 29 and lies on the intermeshing flanges 27 and 28 between the lower parts of the undercut faces 25 and 26 of the respective fixed and movable jaws 16 and 21. As seen in FIG. 4, an offset plate P is wrapped around the cylinder 10 and has end tabs t1 and t2 which are turned inwardly and extend into the recess 29. The offset plate P may wrap smoothly around the cylinder 10 and the arcuate surfaces 16*a* and 21*a* of the jaws, and the end tabs t1 and t2 lie in uninterrupted facing contact with the respective small radius outer margins 25*a* and 26*a* and the undercut faces 25 and 26. When the movable jaw 21 is moved toward closed position the anti-creep means 37 is distorted as seen in FIG. 4, and that distortion produces an inward force component on the tabs t1 and t2 which counteracts a natural tendency of the tabs to bulge at the outer margins of the undercut surfaces as the movable jaw closes.

The anti-creep means 37 is annular in cross section and is seen in FIG. 4 to distort to an oval shape. The anti-creep means is illustrated in the drawings as a spring the coils of which are very open and canted so that the spring distorts as illustrated instead of tending to crush. Alternatively the anti-creep means 37 may be a long tube of suitable stiffness, comparable to that of an O-ring seal.

As seen in FIG. 4, when the movable jaw 21 is in closed position there is a small longitudinal gap G at the back of the jaw, but this need be no more than 0.109 (7/64) inch (2.7 mm) which causes no problem due to plate deflection with steel plates of no less than 0.008 inch thickness (0.203 mm), or aluminum plates at least 0.01 inch (0.254 mm).

Figure 2:
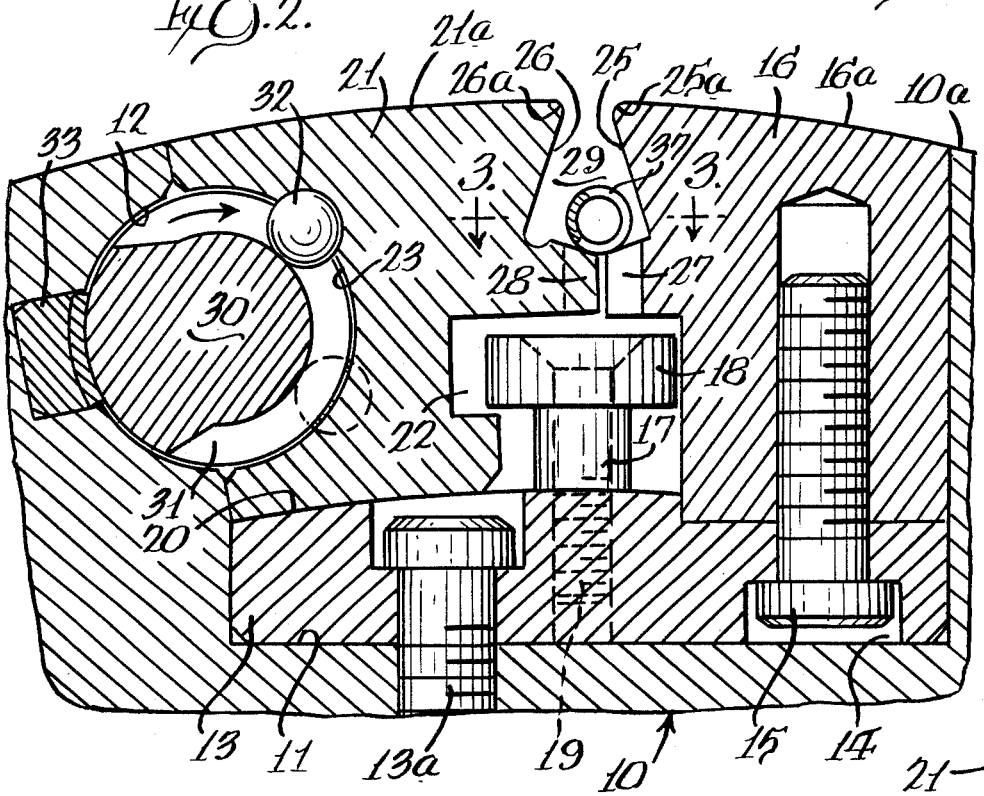
FIG. 2 is a fragmentary sectional view on an enlarged scale taken substantially as indicated along the line 2—2 of FIG. 1, with the movable jaw in open position.
Figure 3:
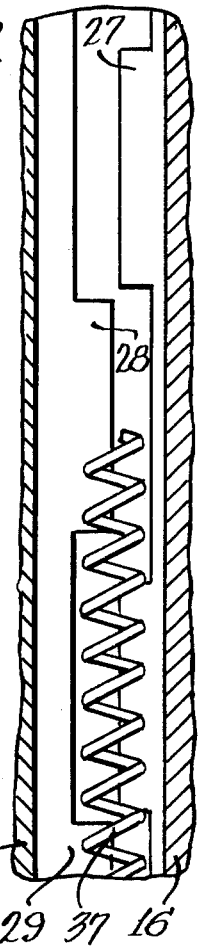
FIG. 3 is a fragmentary sectional view taken substantially as indicated along the line 3—3 of FIG. 2.

As is seen in FIGS. 2 and 4, the base block 13, the fixed jaw 16, the movable jaw 21, the adjusting screw 30 and the thrust bearing 33 occupy nearly the entire cavity created by the slot 11 and the arcuate groove 12; so the balance of the cylinder 10 about its axis is minimally affected.

The foregoing detailed description is given for clearness of understanding only and no limitations should be understood therefrom, as modifications will be obvious to those skilled in the art.

I claim:

1. In a cylinder of a high speed rotary offset web printing machine, gapless lock-up means for an offset plate or a metal backed offset blanket with metal end tabs, said lock-up means comprising, in combination:

a slot in the cylinder surface extending substantially the entire length of the cylinder, said slot being provided with an outwardly facing arcuate surface that is concentric with the cylinder surface;

a fixed jaw and a movable jaw mounted in and occupying the full length of said slot and defining a recess, said jaws having extended arcuate outer surfaces flush with the surface of the cylinder and having facing undercut surfaces the outer margins of which intersect said arcuate outer surfaces along small radii of curvature so that an offset plate or blanket having metal end tabs wraps smoothly around the cylinder with said end tabs lying in uninterrupted facing contact with said outer margins and said undercut surfaces of said jaws, said movable jaw having a multiplicity of inclined recesses spaced generally evenly along a surface that is remote from the fixed jaw, and said movable jaw being seated on said outwardly facing arcuate surface;

intermeshing flanges at the inner margins of said undercut surfaces, said flanges having top faces that cooperate to define the bottom of the recess;

and rigid means for applying effectively uniform lateral force to the movable jaw throughout its length so as to impart translatory motion to said movable jaw across said outwardly facing arcuate surface between an open position and a closed position in which the end tabs at opposite ends of an offset plate or blanket are firmly and rigidly clamped against one another between the undercut jaws immediately adjacent the outer margins of said jaws, said rigid means comprising a rotatable screw with an arcuate groove that extends substantially the entire length of said movable jaw immediately adjacent said inclined recesses, and a ball in each recess engaged with the groove.

2. The combination of claim 1 which includes anti-creep means extending lengthwise of the recess, said anti-creep means lying on the intermeshing flanges and being distorted between the end tabs as the movable jaw is moved toward closed position, the distortion of the anti-creep means producing an inward force component on the end tabs to counteract a tendency of the end tabs to bulge at the outer margins of the undercut surfaces as the movable jaw closes.

3. The combination of claim 2 in which the facing undercut surfaces are planar and diverge from their outer margins to their inner margins.

4. The combination of claim 3 in which the facing undercut surfaces diverge at an angle of about 40°.

5. The combination of claim 4 in which the top faces of the intermeshing flanges lie at a large obtuse angle to one another.

6. The combination of claim 5 in which the large obtuse angle is about 140°.

7. The combination of claim 2 in which the top faces of the intermeshing flanges lie at a large obtuse angle to one another.

8. The combination of claim 7 in which the large obtuse angle is about 140°.

9. The combination of claim 2 in which the anti-creep means is annular in cross section and distorts to an oval shape.

10. The combination of claim 9 in which the anti-creep means is a spring the coils of which are canted.

11. The combination of claim 1 in which the top faces of the intermeshing flanges lie at a large obtuse angle to one another.

12. The combination of claim 11 in which the large obtuse angle is about 140°.

13. The combination of claim 1 which includes spring means biasing the screw endwise.

14. The combination of claim 1 in which the screw has an end at one end of the cylinder, and means at said end for manually rotating the screw.

15. The combination of claim 1 in which the anti-creep means is annular in cross section and distorts to an oval shape.

16. The combination of claim 15 in which the anti-creep means is a spring the coils of which are canted.

17. The combination of claim 1 which includes means biasing the movable jaw toward open position.

18. The combination of claim 1 in which the movable jaw has a portion below the intermeshing flanges that has a longitudinal retaining groove and a plurality of stepped diameter clips that are fixed to the cylinder and have overhanging heads which extend into said retaining groove when the movable jaw is in closed position.

19. The combination of claim 1 in which the outwardly facing arcuate surface is formed upon a base block that is fixed in the bottom of the slot.

20. In a cylinder of a high speed rotary offset web printing machine, gapless lock-up means for an offset plate or a metal backed offset blanket comprising, in combination:

a slot in the cylinder surface extending substantially the entire length of the cylinder, said slot being provided with an outwardly facing arcuate surface that is concentric with the cylinder surface;

jaw means mounted in said slot, said jaw means having extended arcuate outer surfaces flush with the cylinder surface and having facing undercut surfaces with outer margins at which the jaw means are nearest to one another, said undercut surfaces defining the sides of a recess that is adapted to receive metal end tabs of an offset plate or blanket that wraps smoothly around the cylinder and has the end tabs lying in uninterrupted facing contact with said undercut surfaces, said jaw means including a movable jaw that is seated upon said outwardly facing arcuate surface and that has a multiplicity of inclined recesses spaced generally evenly along a surface that is remote from the fixed jaw;

means defining a bottom for said recess adjacent the inner margins of the undercut faces;

and rigid means for applying effectively uniform lateral force to the movable jaw throughout its entire length to move said movable jaw in a translatory manner across said outwardly facing arcuate surface to a closed position of the jaw means in which the end tabs at opposite ends of an offset plate or blanket are firmly and rigidly clamped against one another between the jaws immediately adjacent the outer margins of said jaws, said rigid means comprising a rotatable screw with an arcuate groove that extends substantially the entire length of said movable jaw immediately adjacent said inclined recesses, and a ball in each recess engaged with the groove.

21. The combination of claim 20 which includes anti-creep means in said recess which is gripped between the end tabs as the jaws are moved toward closed position, and which imparts an inward force component on said end tabs.

22. The combination of claim 20 in which the means defining a bottom surface for said recess comprises intermeshing flanges on the jaws.

23. The combination of claim 20 which includes means biasing the movable jaw toward open position.

24. The combination of claim 20 in which the movable jaw includes a portion below the bottom of the recess that has a longitudinal retaining groove and a plurality of stepped diameter clips that are fixed to the cylinder and have overhanging heads which extend into said retaining groove when the movable jaw is in closed position.

25. The combination of claim 20 in which the outwardly facing arcuate surface is formed upon a base block that is fixed in the bottom of the slot.

* * * * *